US008286651B1

(12) United States Patent
Maffett

(10) Patent No.: US 8,286,651 B1
(45) Date of Patent: Oct. 16, 2012

(54) RETRACTABLE BOAT SLIP COVER

(76) Inventor: William C. Maffett, Cookeville, TN (US)

( * ) Notice: Subject to any disclaimer, the term of this patent is extended or adjusted under 35 U.S.C. 154(b) by 365 days.

(21) Appl. No.: 12/755,962

(22) Filed: Apr. 7, 2010

Related U.S. Application Data

(60) Provisional application No. 61/167,183, filed on Apr. 7, 2009.

(51) Int. Cl.
*E04H 15/02* (2006.01)

(52) U.S. Cl. ..... 135/96; 135/97; 135/151; 114/361

(58) Field of Classification Search ..... 114/361, 114/263; 135/96, 97, 128, 131, 151; 405/219; 4/498
See application file for complete search history.

(56) References Cited

U.S. PATENT DOCUMENTS

| | | | | | |
|---|---|---|---|---|---|
| 974,072 | A | | 10/1910 | Kenyon | |
| 2,859,756 | A | * | 11/1958 | Barnes | 135/88.07 |
| 2,887,975 | A | * | 5/1959 | Smith | 114/263 |
| 2,912,703 | A | * | 11/1959 | Murphy | 4/494 |
| 2,964,759 | A | * | 12/1960 | Riggs | 4/498 |
| 2,984,076 | A | * | 5/1961 | Bradley | 405/219 |
| 3,195,549 | A | | 7/1965 | Stevens | |
| 4,096,874 | A | * | 6/1978 | Weatherly | 135/124 |
| 4,393,888 | A | * | 7/1983 | Nivin | 114/201 R |
| 5,390,688 | A | * | 2/1995 | Lipman | 135/97 |
| 5,419,273 | A | * | 5/1995 | Cutler | 114/263 |
| 5,769,105 | A | * | 6/1998 | Margol et al. | 135/90 |
| 5,775,353 | A | | 7/1998 | Johnson | |
| 5,803,104 | A | | 9/1998 | Pollen | |
| 5,839,462 | A | | 11/1998 | Randall | |
| 6,209,477 | B1 | | 4/2001 | Biedenweg | |
| 6,497,074 | B2 | * | 12/2002 | Nelson | 52/2.23 |
| 6,983,716 | B1 | | 1/2006 | Ankney et al. | |
| 7,353,769 | B2 | * | 4/2008 | Unrast et al. | 114/361 |

* cited by examiner

*Primary Examiner* — Stephen Avila
(74) *Attorney, Agent, or Firm* — Waddey & Patterson, P.C.

(57) ABSTRACT

Boat slip cover systems are provided for affixing to piers having a plurality of slips with closed and open ends, and first and second sides. Each boat slip cover includes a flexible canopy. Fixed supports for a first end of the canopy are disposed about the closed end of the slip, at least one extending upward from and perpendicular to the pier surface, and at least one extending upward from and angular to the pier surface. Rotating supports are disposed along each side of the slip and extend upward from the pier. Telescoping joints are disposed along each rotating support for their extension or retraction. A winch device is further provided for manual positioning. A convertible pier cover includes various retractable boat slip covers, valley portions extending between adjacent boat slip covers and forming an attachment on each side to an adjacent boat canopy, and a central aisle canopy.

2 Claims, 2 Drawing Sheets

RETRACTABLE BOAT SLIP COVER

CROSS-REFERENCES TO RELATED APPLICATIONS

This application claims benefit of the following patent application(s) which is hereby incorporated by reference: 61/167,183 filed Apr. 7, 2009.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

BACKGROUND OF INVENTION

Covered boat dock stalls are needed to prevent damage to boats due to sun and rain exposure. Mold, fading and rot are the results from boats moored in open slips.

Covered slips are also detrimental due to added height that requires more support (either by piers or floats). Roofs of covered slips can collect heat and spread heat in the event of fire. Space below roofing provides an environment for birds and spiders and a collecting surface for dust and deterioration. Roofs are also generally not a pleasant atmosphere. The space below is dark and unfriendly. Lighting is usually required, and the metal roofs are unsightly.

A convertible feature for boat moorage has no precedent in the industry. This feature has been used and accepted in automobiles and boats, but the logistics of a static dock require a different approach than canopies for cars or boats. Forces acting on a dock structure are different from forces acting on moving objects. Docks are stationary and static while boats are moving, and horizontal forces are dynamic and direct. Sometimes wind forces are gusty, but the structure must remain somewhat rigid and static. A frame must be able to receive pressure from all directions, not just one from a moving direction.

U.S. Pat. Nos. 974,072; 3,195,549; 5,803,104; 5,839,462; 6,209,477; and 6,983,716 are examples of convertible canopies for water craft, the canopies generally but not exclusively comprising power operated or manual bimini tops. These disclosures fail to describe a system that would effectively extend and retract over a static dock and resist the multidirectional forces of variable strength that are encountered in such docks.

U.S. Pat. No. 5,775,353 describes a boat shelter non-rigidly mounted to a dock. More specifically, a boat shelter dynamically mounted to the dock is described to permit the shelter to move relative to and independent of the dock to accommodate disparate forces experienced by the dock and the shelter. However, the described shelter is not convertible but instead remains in position over the slip at all times.

Therefore a need exists for an extensible and retractable boat slip cover that is rigidly mounted to a boat dock and resists forces from various directions and of variable strength.

A need further exists for such a boat slip cover having telescoping support members wherein water craft of various shapes and sizes may be accommodated beneath the cover.

A need further exists for a boat slip cover having a winch system to more effectively extend and retract the cover by hand.

BRIEF SUMMARY OF THE INVENTION

In one aspect of the present invention, a convertible boat dock cover provides for incorporating the beneficial characteristics of covered boat docks with the desired effects of uncovered slips. When the dock is not in use the boat is protected from the elements by coverage. Further, when openness is desired the canvas roof can easily be retracted and an open effect accomplished thereby.

Other positive features include lighter weight, lower cost, the ability to convert existing open slips to covered slips without providing additional support and openness to prevent the collection of heat. The conversion is simple and requires little time and effort.

The boat dock cover of the present invention provides full restraint in all directions. The spacing of the column supports provides for the least amount of area to be exposed to wind forces. This is especially true when the roof is retracted.

Some or all of the support metal columns may also be telescoped. This allows for adjustment if additional height requirements change.

The extensible and retractable features of the boat dock cover of the present invention further permit boat slips to be less wide than are otherwise possible. The roofs in a covered dock can only extend as far as the supporting walkway extends from the main aisle. Retractable covering permits the walkway to be built only as far as necessary to maintain and enter the water craft enclosed within the slip. In this manner the turning radius of a water craft entering or exiting the slip is enhanced, and theoretically a greater number of parallel boat piers may be constructed using the same space with respect to the shoreline.

Briefly stated, the invention comprises one or more boat slip cover systems affixed to a pier having a plurality of slips, each slip further comprising a closed end, an open end, and a first and a second side. Each boat slip cover further comprises a tensioned canopy preferably comprised of a flexible material such as canvas.

A plurality of fixed support members are disposed about the closed end of the slip, at least one of the support members extending upward from the pier and perpendicular to the surface of the pier, and at least one of the fixed support members extending upward from the pier and angular to the surface of the pier, the perpendicularly and angularly extending support members forming an attachment and supporting a first end of the canopy.

A plurality of rotating support members are disposed along each side of the slip and extending upward from the pier. The rotating support members further comprise one or more telescoping joints, wherein the height of the canopy may be adjusted.

The support members disposed on each side of the slip are disposed directly in opposition to the support members on the opposing side of the slip, and the opposing support members may further generally comprise a single inverted U shaped attachment for further support.

A winch device is further provided wherein the angle of the rotating support members may be manually positioned.

A convertible pier cover comprises a plurality of such retractable boat slip covers and one or more valley portions each extending between adjacent boat slip covers, each valley forming an attachment on each side to an adjacent boat canopy. A central aisle cover can be attached to the fixed support members at the back of the slip by mounting a structural gutter to the fixed frame that supports ribs and canvas (or other flexible material) covering. This is unique in that there is not a known system of boat coverage that combines with tension fabric construction.

The central aisle cover is a fixed tension fabric structure and is not convertible.

DETAILED DESCRIPTION OF THE INVENTION

Figure 1:
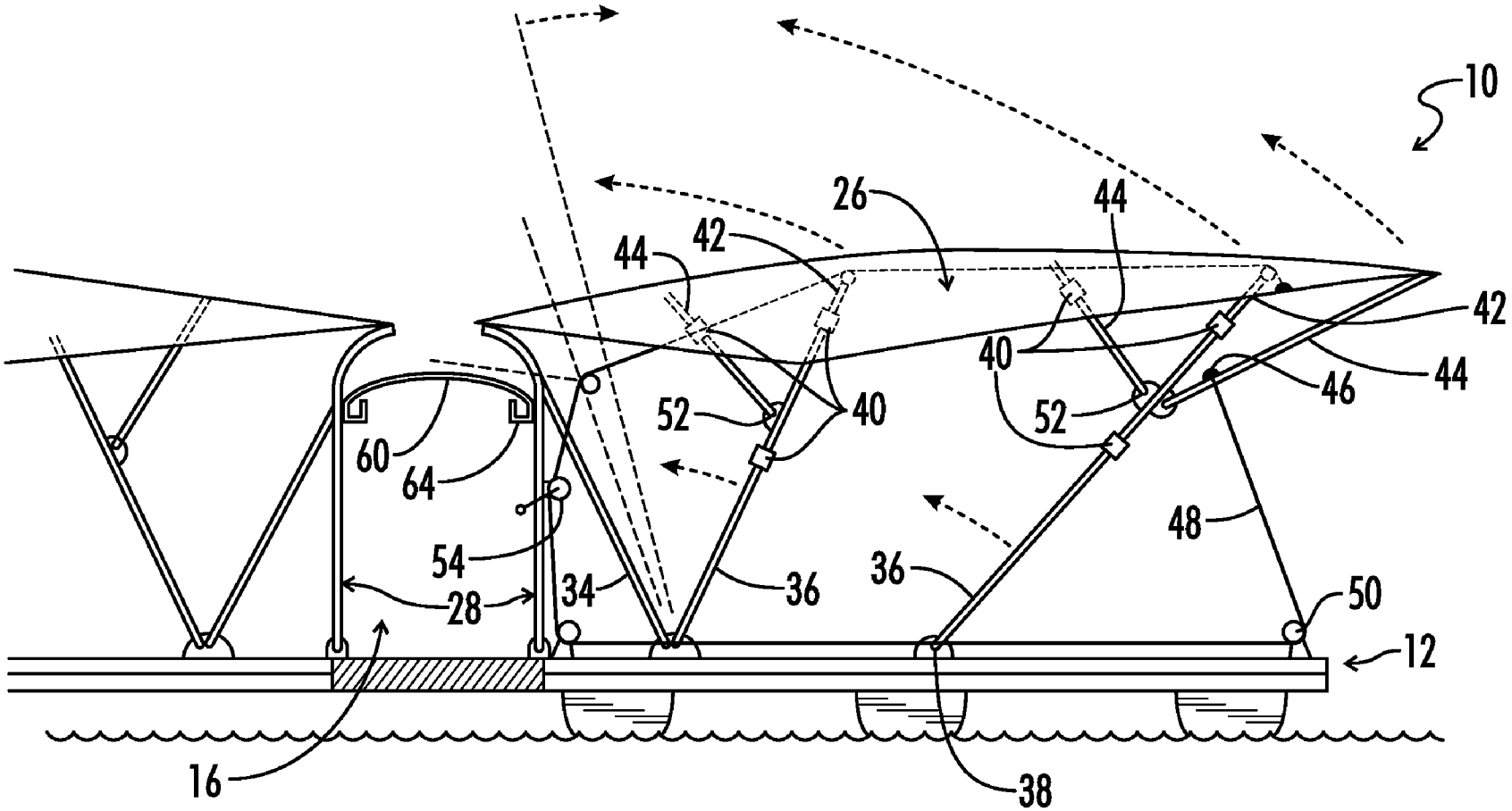
FIG. 1 is a side view rendering of an embodiment of the retractable boat slip cover of the present invention.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may.

Where the various figures may describe embodiments sharing various common elements and features with other embodiments, similar elements and features are given the same reference numerals and redundant description thereof may be omitted below.

Various embodiments of a retractable boat slip cover may be described herein for providing boat owners with the option of enjoying the positive benefits of covered and uncovered boat slips. In a particular embodiment, a plurality of such retractable covers are disposed about adjacent slips and connected so as to provide a convertible pier cover. The pier cover further comprises a covered aisle with gutters extending along its length such that boat owners and other users may derive the same benefits when not under an individual boat cover.

Figure 2:
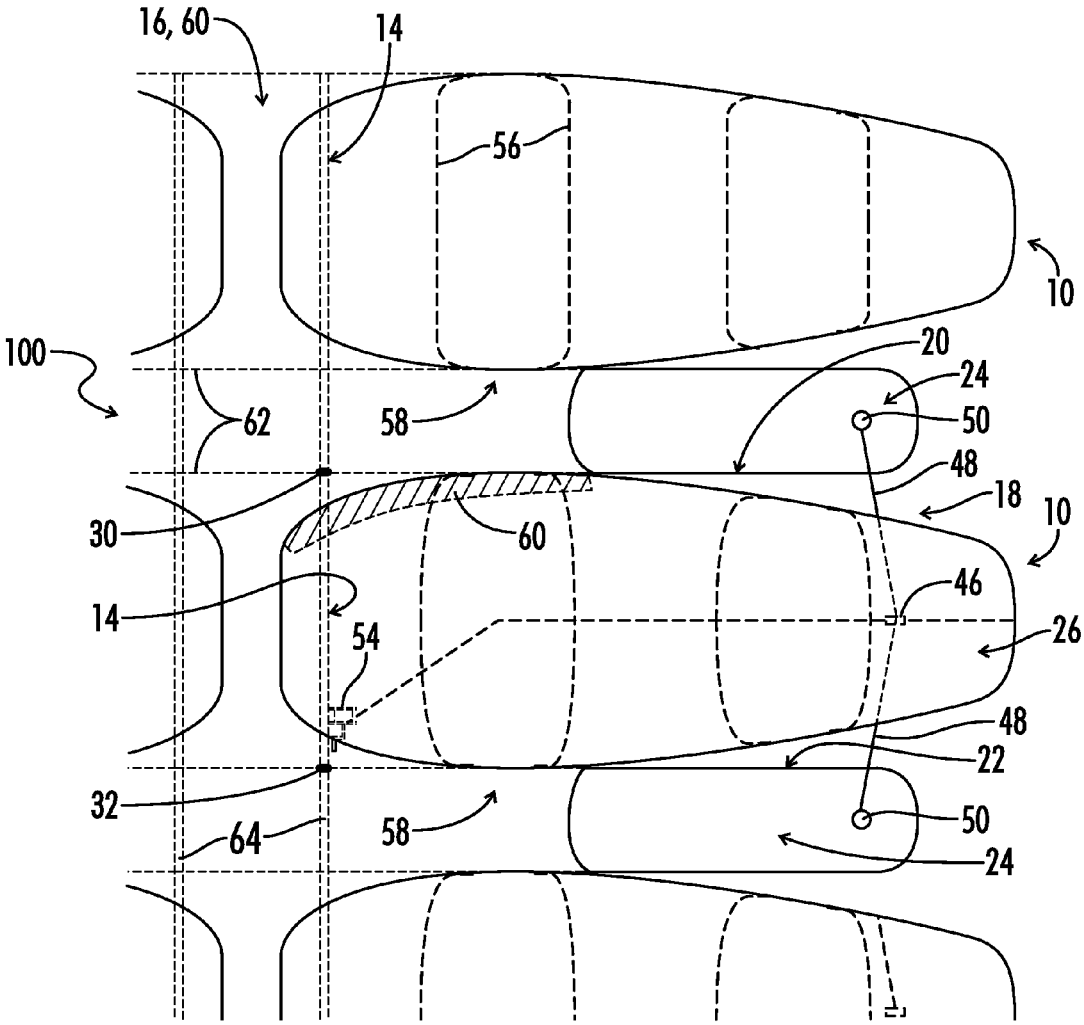
FIG. 2 is a top view rendering of a combination of retractable boat slip covers as in FIG. 1, comprising an embodiment of the convertible pier cover of the present invention.

Referring generally to FIGS. 1-2, an embodiment of the retractable boat slip cover system 10 may be further described. The system 10 is designed for a stationary boat dock, wherein the cover may be extended or retracted without regard for whether a boat is physically present in the associated slip. The system 10 extends for example over a slip 12 having a closed end 14 adjacent a central walkway 16 or aisle 16 of the pier, an open end 18 facing outward from the dock, and first and second sides 20, 22. The first and second sides 20, 22 of the slip 12 abut abbreviated walkways 24 perpendicular to the central walkway 16 of the pier, such that the slip 12 is generally rectangular in shape.

A cover 26 or canopy 26 in the displayed embodiment is constructed of a flexible material operable to extend in a generally horizontal direction and cover substantially the interior of the slip 12, and to retract to the closed end 14 of the slip 12 wherein substantially the interior of the slip is exposed to the elements and generally open. In this embodiment the canopy 26 may be constructed of a tensioned fabric-based material such as for example canvas or an equivalent. In this embodiment the substantially horizontal configuration of the extended canopy 26 further provides a reduced profile for wind pressure than is possible for more sloped applications. In other embodiments however the canopy may be shaped to extend in any configuration as desired to accommodate any shape or size of boat positioned within the slip.

Referring further to an embodiment such as shown in FIG. 1, the boat slip cover system 10 of an embodiment as shown comprises two fixed vertical support members 28 or fixed frames 28 at the closed end 14 of the slip 12, one positioned on a corner 30 associated with the first side 20 and the other positioned on a corner 32 associated with the second side 22. The fixed vertical support members 28 in this embodiment are attached to the body of the dock and therefore stationary with the dock. Two fixed angular support members 34 or frames 34 are further positioned near the closed end 14 of the slip 12, with one fixed angular support member 34 on the first side 20 and the other on the second side 22 of the slip 12. Each fixed angular support member 34 is attached to the body of the deck walkway 24 and extends upward and toward the associated fixed vertical support member 28. The two members on each side (one vertical member 28 and one angular member 34) form an attachment and generally together form a triangular support member 28, 34 with respect to the body of the dock.

Two rotating support members 36 or frames 36 are further positioned on both of the first and second sides 20, 22 of the slip 12. Each rotating support member 36 is attached to the body of the deck. In an embodiment of the boat slip covering system 10 as shown in FIG. 1, one of the rotating members 36 on each side 20, 22 is operably attached to the dock at the same location 38 as the fixed angular support member 34 on the associated side 20, 22. The rotating support members 36 and the fixed support members 28, 34 of this embodiment may generally be constructed of metal. Each of the support members 28, 34, 36 further function to support the canopy 26 in either of the retracted or expanded positions.

The positioning of the support members 28, 34, 36 provide for stable support of the canopy. The boat slip covering system 10 anticipates dynamic and direct horizontal forces to be applied by wind pressure from all sides. Sometimes the wind may be particularly gusty, but the structure should remain rigid and static. The triangular positioning of the fixed support members 28, 34 is operable to receive such pressure from all sides, rather than just a moving direction as with a covering system mounted to a boat. The spacing of the support members 28, 34, 36 further minimizes the surface area upon which the wind may act, particularly when the canopy 26 is retracted. Even when the canopy 26 is extended, the spacing in combination with the generally horizontal extension of the canopy 26 functions to minimize the wind shear profile as well.

In various embodiments of the boat slip covering system 10 as shown in FIG. 1, the rotating support members 36 may be further telescoping to allow for additional height adjustments of the canopy 26 where desired. In this manner the telescoping support members 36 further comprise one or more telescoping joints 40. The telescoping joints 40 permit one or more extension members 42 to be positioned at a top end of the rotating support members 36, whereby an effective length of the rotating support members 36 may be manually adjusted. When the extension members 42 are positioned so as to maximize the effective length of the rotating support members 36, the resultant effect is that the height of the canopy 26 itself is further maximized. Likewise, when the extension members 42 are positioned (or in various embodiments removed) so as to minimize the effective length of the rotating support members 36, the resultant effect is that the height of the canopy 26 is also minimized.

Supplemental extension members 44 may be attached by pin connections 52 or various equivalent fastening mechanisms to the rotating support members 36 at a variety of angles incident to the angle of the associated rotating support member 36, as further shown in FIG. 1. In this manner the canopy 26 is more effectively supported by a minimum of anchored support members 28, 34, 36. In certain embodiments of the boat slip covering system 10 each of the extension members 42, 44 are manually adjustable wherein the substantially horizontal configuration of the canopy 26 is maintained when the canopy 26 is fully extended.

In an embodiment of the boat slip covering system 10 as shown in FIG. 1, the telescoping joints 40 attached to the rotating support members 36 positioned furthest from the closed end 14 of the slip 12 may further comprise a cable connection 46 wherein a cable 48 may be attached to both of the telescoping joint 40 and the body of the dock. The cable 48 when positioned in such a manner provides further support to the canopy 26 when in an extended position.

In certain embodiments the cable 48 may be retractable to a device 50 attached to the body of the dock walkway 24 when the canopy 26 is retracted, and extended to facilitate a connection 46 with the telescoping joint 40 when the canopy 26 is extended.

In alternative embodiments of the boat slip covering system 10, the telescoping support members 36 may be connected with set screws or equivalent fastening devices (not shown). The extension members 42, 44 may be similarly connected to the telescoping members 36 using set screws or equivalent fastening devices (not shown).

An embodiment as shown in FIG. 1 further comprises a winching apparatus 54 wherein the canopy 26 may be manually retracted and extended. The winch 54 may be operably connected to one or more of the support members 28, 34, 36, with the rotating support members 34, 36 directly receptive to manual adjustment by a user. The winch 54 in an embodiment of the boat slip covering system 10 is potentially limited in movement only by the tensioned capacity of the canopy 26 in one direction, and by the fixed support members 28 in the opposite direction.

Various embodiments of the system 10 as shown generally in FIGS. 1-2 may include support members 28, 34, 36 disposed along the first and second sides 20, 22 of the slip 12 in direct opposition to each other. The opposed support members 28, 34, 36 in certain embodiments curve inward at their maximum height and extend over the slip 12 so as to form an attachment with each other in an inverted U shape. In this manner the structure is even further supported from wind shear, while providing a stable apparatus over which the canopy 26 may be draped, tied, or otherwise affixed such as by channeling the support members through a sleeve (not shown) formed on the underside of the canopy 26.

In alternative embodiments each set of support members 28, 34, 36 disposed in direct opposition to each other may further include a cross brace (not shown) forming an attachment with the opposed support members 28, 34, 36 so as to provide further support.

Referring further to FIG. 2, the canopy 26 of an embodiment of the system as shown may include canopy ribs 56 extending from side to side at various locations generally corresponding to the areas where the inverted U of the support members 34, 36 contact the canopy 26. In alternative embodiments the canopy ribs 56 may extend from side to side at various locations generally corresponding to the areas where cross braces contact the canopy 26.

As further shown in FIG. 2, certain embodiments of the present invention may further comprise a combination of boat slip covering systems 10 to form a convertible pier covering system 100. As further displayed, adjacent boat slip covering systems 10 in such a pier covering system 100 may include a plurality of canopy valleys 58 wherein material stretches between the slip covering systems 10 and prevents rain or other elements from striking the walkway 24 associated with the sides of the adjacent slips 12. The canopy valleys 58 may be folded on one side when their presence is unnecessary.

In certain embodiments the material may be attached on one side in a relatively permanent fashion to a canopy 26, and may be formed of Velcro 60, zippers or other equivalent fastening mechanisms on the other side for attaching to the adjacent canopy 26. In the alternative, both sides of the material may be formed of Velcro 60, zippers or other equivalent fastening mechanisms such that the material between canopies 26 may be removed entirely as desired.

A central walkway cover 60 or aisle canopy 60 in various embodiments further extends along a central walkway 16 of the dock and adjacent to the associated slips covering systems 10. The central walkway cover 60 may further be formed of a plurality of walk ribs 62 wherein the cover 60 is supported in a fixed position and is not retractable or otherwise convertible. The central walkway cover 60 may further be connected to the individual adjacent boat slip covering systems 10 by a pair of gutters 64, one on each side of the central walkway cover 60. The gutters 64 collect runoff from each of the central walkway cover 60 and the plurality of boat slip covering systems 10, substantially preventing exposure to the undesirable elements for the length of the central walkway 16.

Although there have been described particular embodiments of the present invention of a new and useful Retractable Boat Slip Cover, it is not intended that such references be construed as limitations upon the scope of this invention except as set forth in the following claims.

What is claimed is:

1. A pier covering system, comprising:

one or more boat slip cover systems affixed to a pier having a plurality of slips, each slip further comprising a closed end, an open end, and a first and a second side, each system further comprising:

a canopy comprising a flexible material;

a plurality of fixed support members disposed about the closed end of the slip, at least one of the fixed support members extending upward from the pier and perpendicular to the surface of the pier, and at least one of the fixed support members extending upward from the pier and angular to the surface of the pier, the perpendicularly and angularly extending support members forming an attachment and supporting a first end of the canopy;

a plurality of rotating support members disposed along each side of the slip and extending upward from the pier;

one or more telescoping joints each disposed along an associated rotating support member, wherein a length for each said rotating support member may be manually extended or retracted; and a winch device wherein the rotating support members are operable to be manually positioned;

one or more valley portions, each valley extending between each adjacently disposed boat slip cover system, said valley forming an attachment on each side to an adjacent boat canopy; and a central aisle canopy extending adjacent to each boat slip cover system, said central aisle canopy further comprising a first gutter disposed along a first side and a second gutter disposed along a second side.

2. The system of claim 1, wherein the fixed and rotating support members disposed along the first side of the slip are directly opposed to associated fixed and rotating support members along the second side of the slip, the apparatus further comprising a one or more cross members each forming an attachment with a set of opposed support members.

* * * * *